US007571736B1

(12) United States Patent
Chu

(10) Patent No.: US 7,571,736 B1
(45) Date of Patent: Aug. 11, 2009

(54) ILLUMINATED UMBRELLA

(76) Inventor: Wai Chuen Chu, 841 Overlook Ct., San Mateo, CA (US) 94403

( * ) Notice: Subject to any disclaimer, the term of this patent is extended or adjusted under 35 U.S.C. 154(b) by 0 days.

(21) Appl. No.: 12/197,189

(22) Filed: Aug. 22, 2008

(51) Int. Cl.
*A45B 3/04* (2006.01)

(52) U.S. Cl. ..... 135/16; 135/28; 135/910; 362/102

(58) Field of Classification Search ..... 135/16, 135/910; 362/102
See application file for complete search history.

(56) References Cited

U.S. PATENT DOCUMENTS 3,313,929 A * 4/1967 Schiavone ..... 362/102
4,031,381 A * 6/1977 Carver ..... 362/102
5,323,798 A * 6/1994 Yang ..... 135/16
5,502,624 A * 3/1996 Tu ..... 362/102
6,089,727 A * 7/2000 Wu ..... 362/102
6,341,873 B1 * 1/2002 Yang ..... 362/102
6,991,341 B1 * 1/2006 Khor ..... 362/102
2006/0096625 A1 * 5/2006 Chen et al. ..... 135/16

* cited by examiner

*Primary Examiner*—David Dunn
*Assistant Examiner*—Noah Chandler Hawk

(57) ABSTRACT

An umbrella or parasol having a plurality of LEDs (Light-Emitting Diodes) or other lightweight, energy conservative, light sources mounted proximate the distal ends of stretcher struts spreading and tensioning a ribbed umbrella canopy is described for both brightly illuminating the carrier and lighting an area surrounding the carrier on dark, rainy nights.

2 Claims, 6 Drawing Sheets

ILLUMINATED UMBRELLA

BACKGROUND OF THE INVENTION

1. Field of the Invention

This invention relates to an umbrella or parasol illuminated by LEDs (Light-emitting diodes) or similar energy efficient, lightweight devices powered by electrical batteries.

2. Description of the Prior Art

Walking in high traffic areas on rainy days can be dangerous due to the low visibility. On dark, rainy nights an illuminated umbrella carried by pedestrian is highly visible to approaching motorists, motorcyclists and other pedestrians, thereby, substantially minimizing the probability of an accident. Such umbrellas also light the way for the beleaguered pedestrian.

Illuminated umbrella and parasols are well known in the art. Historically, many different approaches have been described and developed for illuminating umbrellas and canes for protecting pedestrians on dark, rainy nights. In fact, the U.S. Manual of Patent Classification has several subject matter classes and subclasses dedicated to such items. In particular, subject matter class 135 for tents, canopies, umbrellas or canes includes a cross-reference art collection in subclass 910 covering canes or umbrellas disclosed as having light-emitting sources such as flashlights, lamps or LEDs that are particularly useful when used at night. Also, subject matter class 362, for illumination includes a subclass 102 that specifies umbrellas combined with illumination.

SUMMARY OF THE INVENTION

An umbrella/parasol is described having a plurality of LEDs (Light-Emitting Diodes) or other lightweight, energy conservative, light sources mounted proximate the distal ends of stretcher struts spreading and tensioning a ribbed umbrella canopy for both brightly illuminating the carrier and lighting an area surrounding the carrier. Positioning the LED light sources proximate the ends of the umbrella stretcher struts places them above the line-of-sight of the pedestrian carrying the umbrella/parasol minimizing interference with the carrying pedestrian's night vision, while the overhanging opened umbrella canopy shields the LEDs from the line-of-sight of oncoming pedestrians and other traffic.

An aspect of the invented luminous umbrella relates to a simple contact mechanism for electrically energizing the strut mounted LEDs utilizing a novel cylindrical spring assembly to complete electrical circuits between the LEDs and a battery power source conventionally located in the umbrella handle.

DESCRIPTION OF PREFERRED AND EXEMPLARY EMBODIMENTS

Brief Description of the Drawings:

Closely related figures have the same numbers but different alphabetic suffixes.

DETAILED DESCRIPTION OF EXISTING AND PREFERRED EMBODIMENTS

Figure 1:
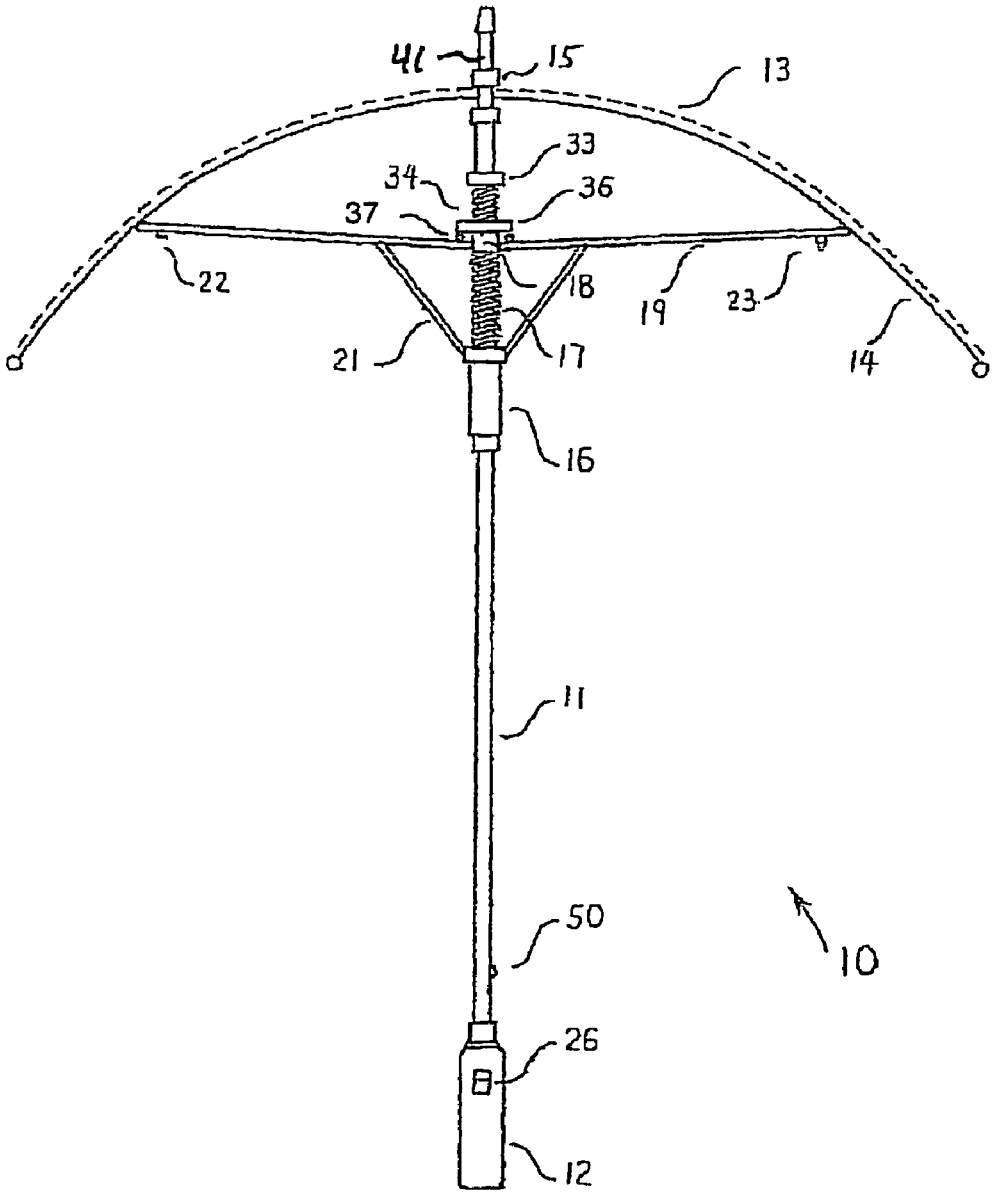
FIG. 1 is a representative side view of an embodiment of the invented umbrella.

As shown in FIG. 1, the umbrella 10, resembles a conventional umbrella, including a central hollow umbrella shaft 11, with a bottom handle 12 and a spreadable canopy 13 deployed at the top end. The canopy 13 incorporates a typical radial array of canopy ribs 14 for spreading and supporting the canopy 13. The proximal ends of the canopy ribs 14 are pivotally secured to a canopy ring 15 supported by a terminal ferrule 41 capping the umbrella shaft. A conventional runner sleeve 16, absorbing spring 17 and a strut sleeve 18 are journaled around, serially, one above the other, and slide up and down the umbrella shaft 11 for respectively opening and closing the umbrella canopy 13.

To explain, typically a plurality of stretcher struts 19, each conventionally, pivotally coupled between a canopy rib 14 at its distal end, and the strut sleeve 18 at its proximal end, pivot between a vertical (closed) position more-or-less parallel to the umbrella shaft 11 to a horizontal (open) position more-or-less perpendicular to the umbrella shaft 11 spreading the canopy ribs 14 secured at their proximal ends to the canopy ring 15 supported by the terminal ferrule 41 capping the top end of the umbrella shaft 11. A plurality of actuator struts 21 in turn, are each conventionally, pivotally interconnected between a stretcher strut 19 and the runner sleeve 16 for pivoting the stretcher struts 19 between the vertical (closed) position and the horizontal (open) position as the runner sleeve 16 is respectively slid up and down the umbrella shaft 11.

Sockets 22 for accepting electrical connection pins 20 of LED or other light sources 23 are mounted proximate the distal end of each stretcher strut 19.

The umbrella shaft 11, the stretcher struts 19, the actuator struts 21, the canopy ribs 14 and canopy ring 15 are typically formed from structural metal materials that are electrically conductive. On the other hand the bottom handle 12, the runner sleeve 16, the strut sleeve 18 and the terminal ferrule 41 are typically molded from structural plastic materials that are not electrically conductive.

Figure 3:
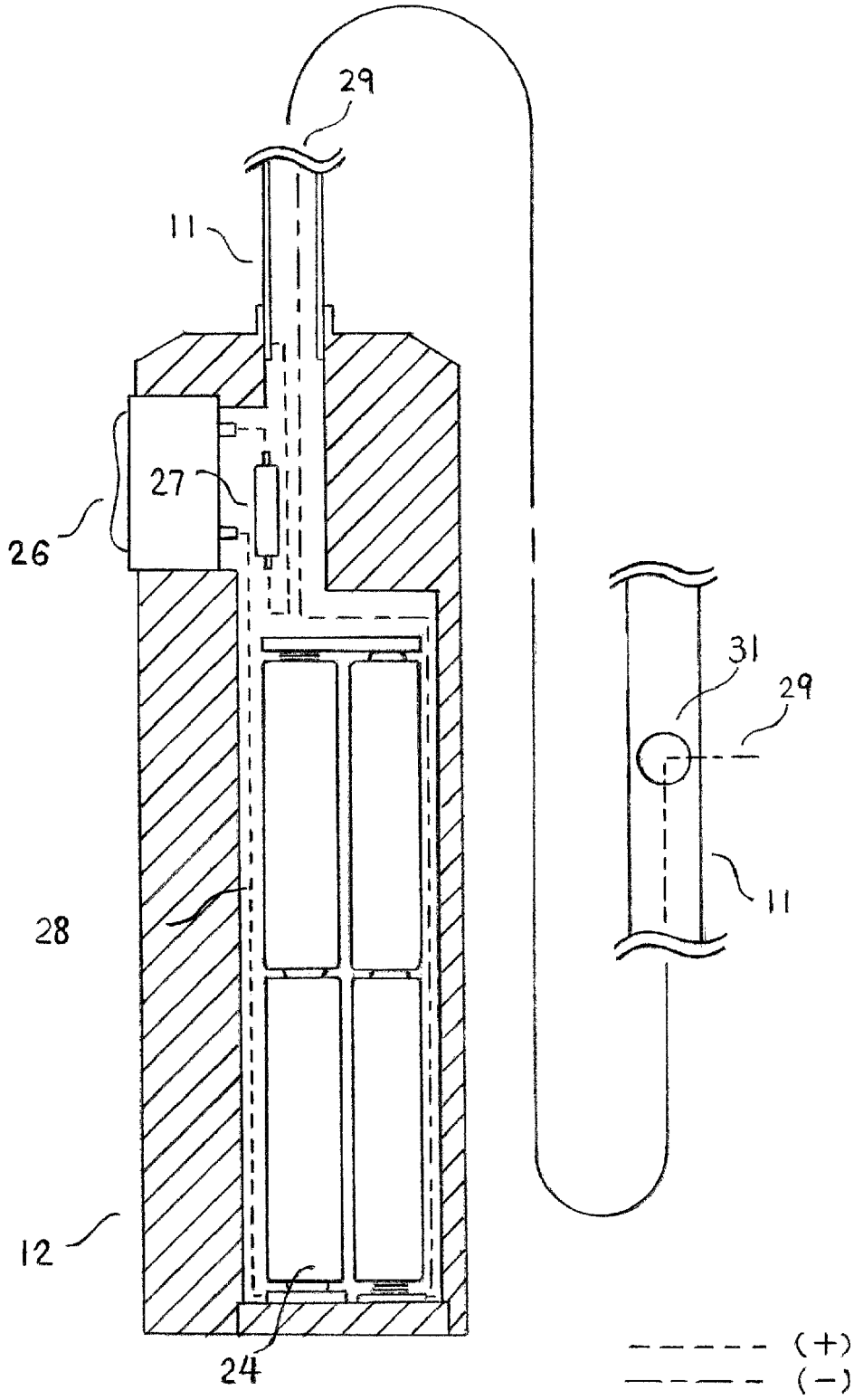
FIG. 3 is a representative cross section, side elevation view of an embodiment of an umbrella handle containing batteries for electrically energizing the LEDs.
Figure 4:
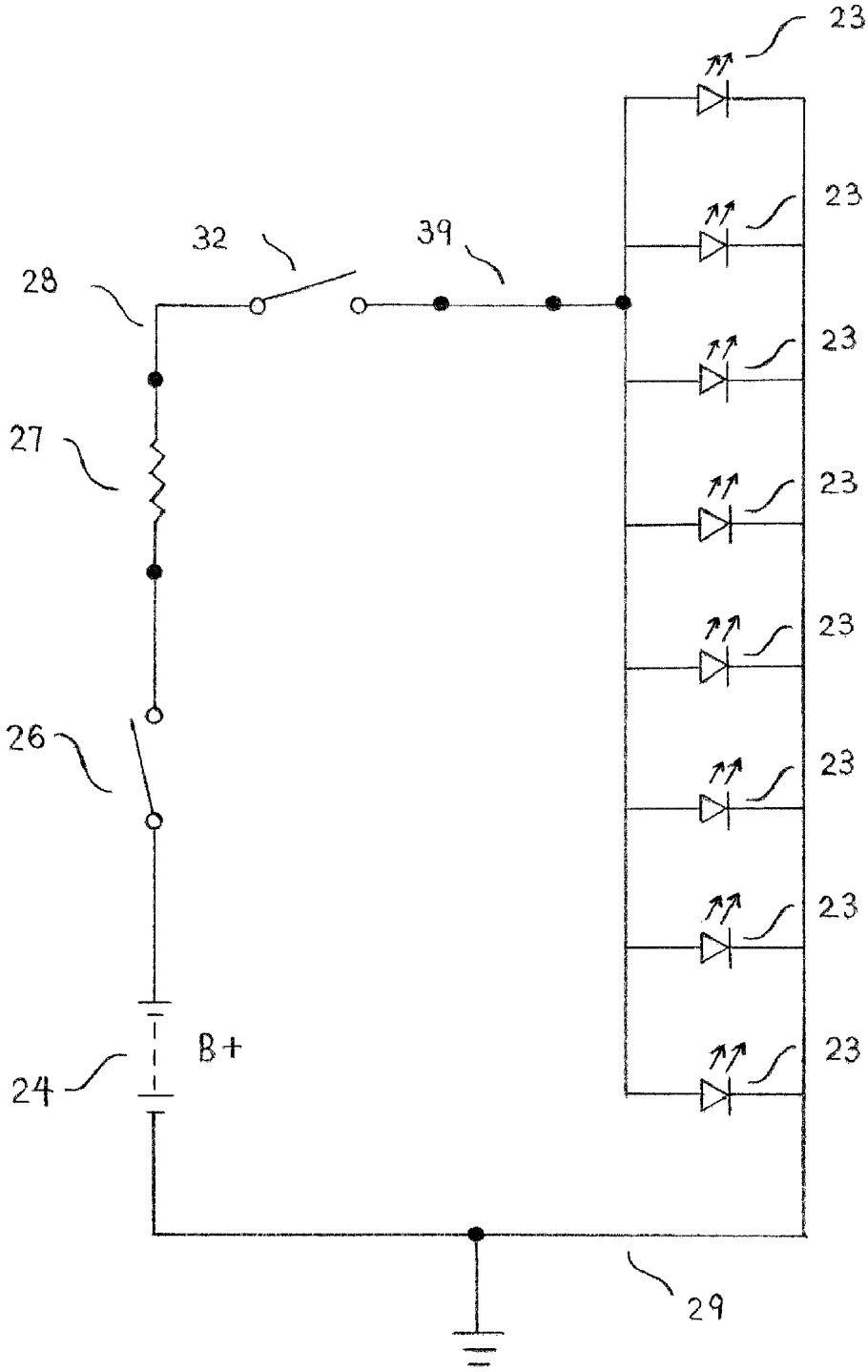
FIG. 4 is a representative electrical schematic of an embodiment of an electrical circuit including a battery power source, a handle switch and the spring actuated contact mechanism in the electrical circuit for energizing the LEDs.

Looking at electrical circuit schematic of FIG. 4, the components for energizing the LED light sources 23 may include a DC electrical power source 24, (e.g., a conventional array of replaceable batteries) a conventional manual ON-OFF switch 26, and a current limiting resistor 27, all conventionally, electrically connected together and incorporated into the structure of the handle 12 at the bottom end of the umbrella shaft 11. As shown in FIG. 3, a positive insulated wire lead 28 connects between the current limiting resistor 27 in the handle 12 to the hollow umbrella shaft 11. A negative insulated wire lead threads 29 from the handle 12 up through to the hollow umbrella shaft 11 and out a wire port 31 through the umbrella shaft wall located above the strut sleeve 18 at the open position (FIG. 2C) for electrically connecting the handle components, 24, 26 & 27, to the umbrella contact components 32 completing an electrical circuit for energizing the LED light sources 23.

Figure 2A:
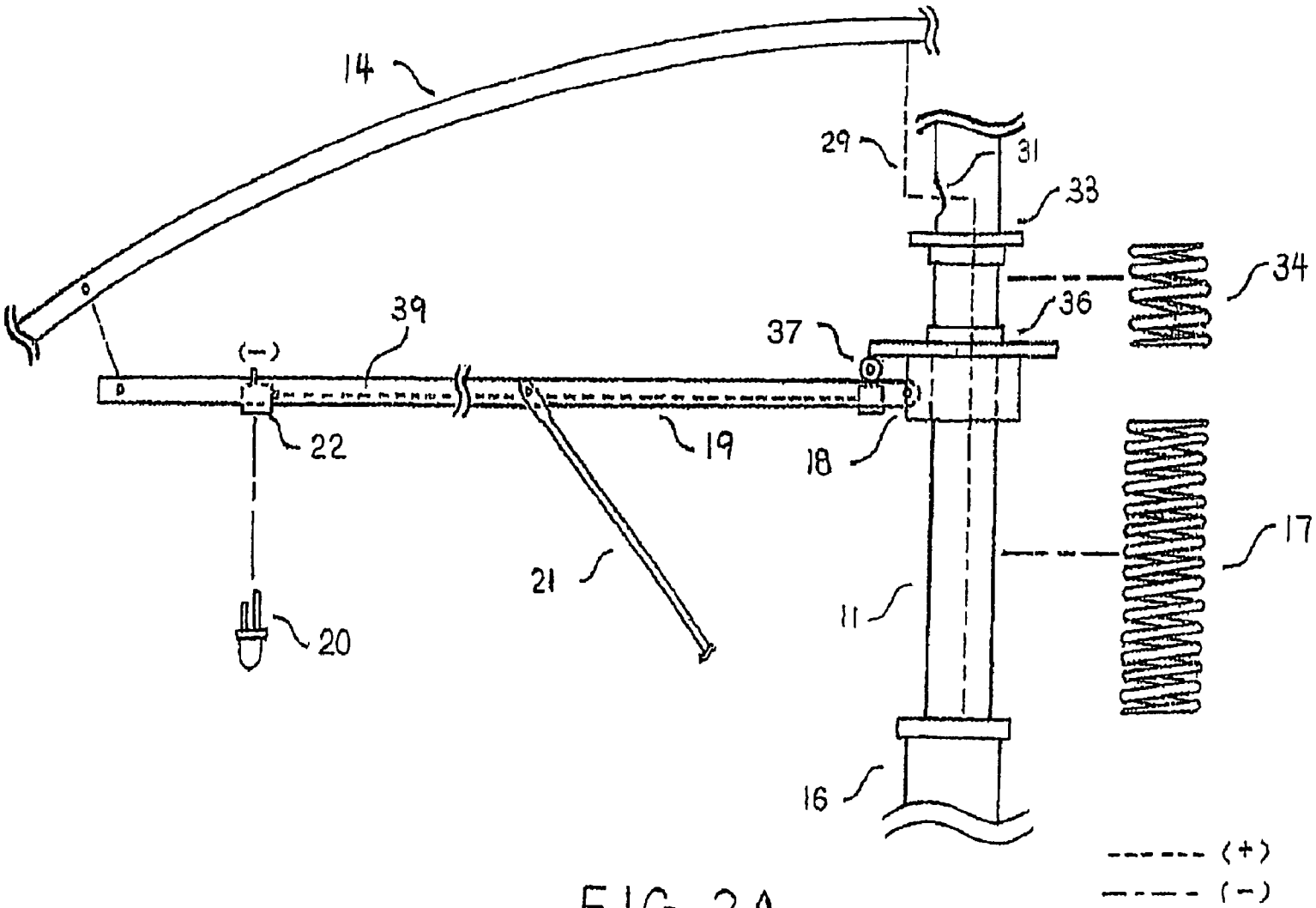
FIG. 2A is a representative side view of an embodiment of a spring-actuated mechanism for closing an electrical circuit for energizing the LEDs.
Figure 2B:
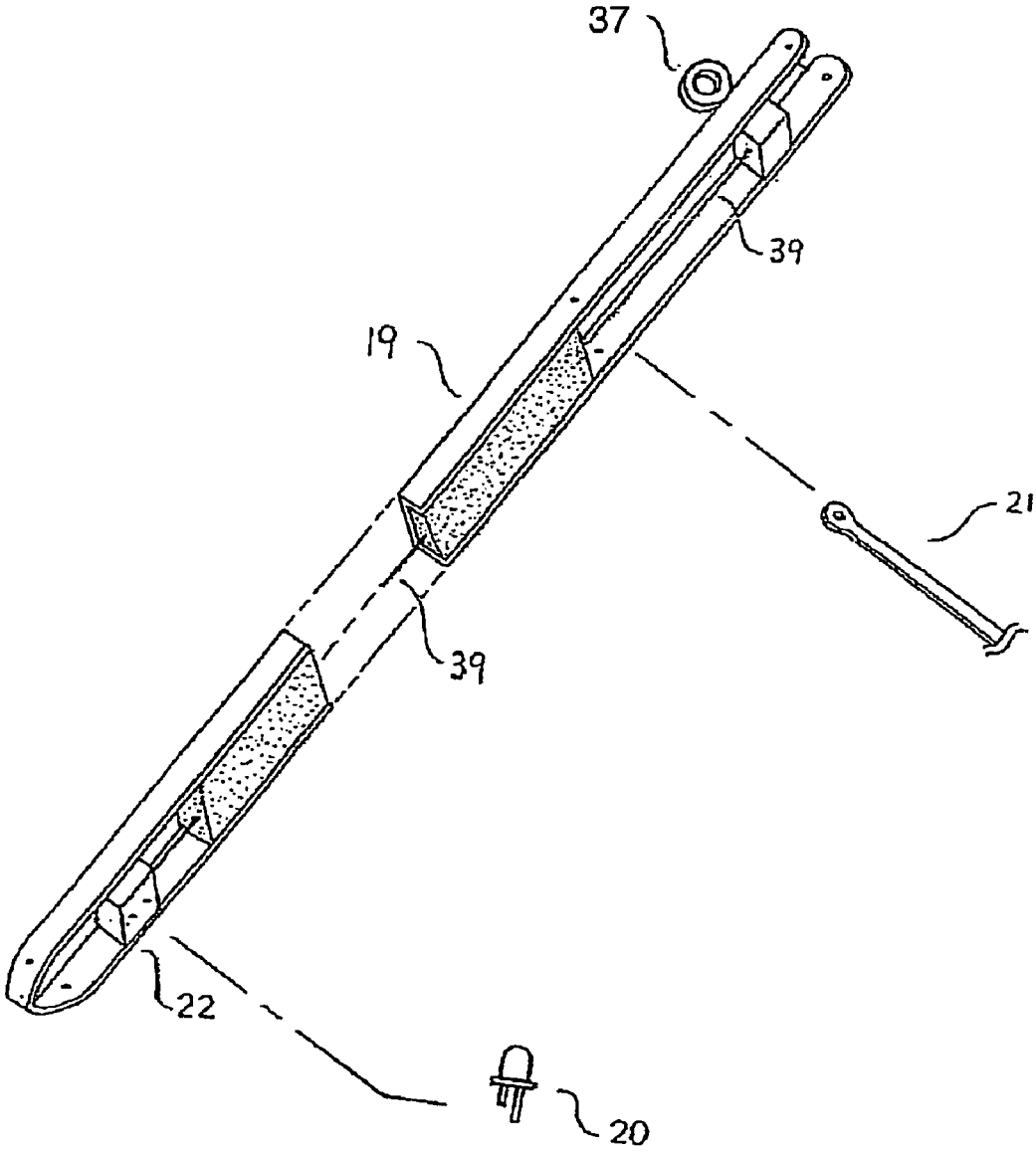
FIG. 2B is a representative exploded view of an embodiment of a stretcher strut for the invented umbrella.
Figure 2C:
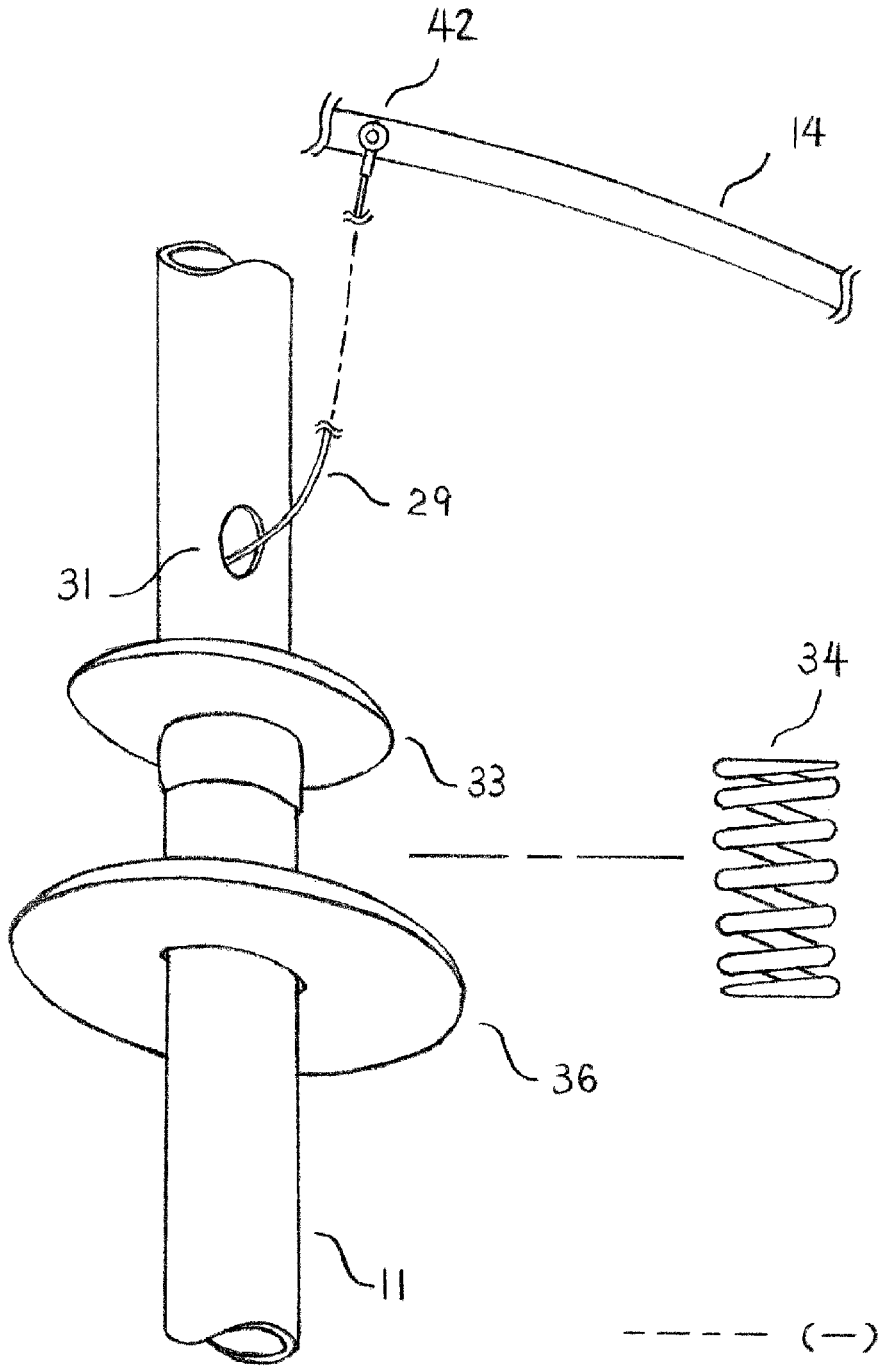
FIG. 2C is a representative perspective view showing an embodiment of elements of the spring-actuated contact mechanism completing electric circuits for energizing the illuminating LEDs.

In particular, with reference to FIGS. 2A, 2B, & 2C and 3, a suitable contact mechanism for completing the energizing electrical circuit (schematically indicated at 32 in FIG. 4) may include:

(i) an electrically conductive umbrella shaft;

(ii) an electrically conductive spring ferrule 33 with an annular shoulder 34 secured around and electrically connecting with the umbrella shaft 11 located slightly below the wire port 31;

(iii) an electrically conductive, annular contact plate 36 mounted around and carried by the strut sleeve 18;

(iv) an electrically conductive spring 34 journaled around the umbrella shaft 11 sandwiched between the spring ferrule 33 and the strut sleeve 18 sized to be compressed between the conductive annular shoulder 34 of the spring ferrule 33 and the conductive, annular contact plate 36 mounted around the strut sleeve 18;

(v) an electrical contact 37 mounted at proximal end of each stretcher strut 19 dimensioned and located to engage and establish an electrical connection with the undersurface of the annular contact plate 36 when the stretcher struts 19 are pivoted to the horizontal (open) position more-or-less perpendicular to the umbrella shaft 11;

(vi) an insulated wire lead 39 connecting between the electrical contact 37, and the positive pin of the LED light source 23 received in the socket 22 mounted proximate the distal end of each stretcher strut 19; and (vii) a grounding electrical connection between the negative pin of the LED light source 23 received in the socket 22 mounted proximate the distal end of each stretcher strut 19; and (viii) an electrical conduction path via the pivot couples between the distal end of each stretcher strut 19, and a canopy rib 14, that in turn couple, mechanically and electrically, to the canopy ring 15 supported by the terminal ferrule 41 capping the umbrella shaft 11 then via the canopy ring 15 to the negative wire lead 29 connected to, for example, one of the canopy ribs 14 as shown in FIG. 2C.

It should be appreciated that both the runner and strut sleeves 16 & 18 of the umbrellas 10 need to be composed of electrically insulating, structural plastic polymers materials, including nylon, polyurethane and the like that, while the umbrella shafts 11, canopy ribs 14 stretcher struts 19, anchor struts 21, canopy ring 15 and the connections between the latter elements typically should be composed of an electrically conductive, structure materials (metals). Where the umbrella 10 has a non-conductive umbrella shaft 11, a positive wire lead 28 could similarly thread up the hollow umbrella shaft 11 exit out the wire port to electrically connect to the spring ferrule 33.

As described, the LED light sources 23 only energizes when the umbrella 10 is in the open position. During daytime the pedestrian carrier can use the manual ON-Off switch 26, to interrupt the electrical energizing circuit turning off the illuminating LED light sources 23.

Further a skilled ergonomic designer should recognize that the respective LEDs when energized may emit light at different light frequencies (colors) and even blink for design and/or to enhance noticeability to others.

Also those skilled in the art should also note and appreciate, that while the umbrellas and parasols for both brightly illuminating a carrier and lighting an area surrounding a carrying pedestrian are described in context of particular elements, to achieve a desired functionality, constraints imposed by different mechanical umbrella systems and materials, can and will give rise to different combinations of elements, yet perform substantially the same function, in substantially the same way to achieve substantially the same result as the components described and specified above.

Accordingly, while mechanical components suitable for implementing the invented combination of umbrellas and parasols and illumination may not be exactly described herein, they may fall within the spirit and the scope of invention as described and set forth in the appended claims.

I claim:

1. An umbrella for illuminating a pedestrian and an area surrounding the pedestrian on dark, rainy nights having a central, hollow umbrella shaft with a bottom handle and a spreadable canopy deployable at a top end where the canopy incorporates a typical radial array of canopy ribs coupled to a canopy ring supported by a capping ferrule terminating the top end of the hollow central umbrella shaft for spreading and supporting the canopy, actuated by a runner sleeve, an absorbing spring and a strut sleeve journaled around, serially, one above the other, sliding up and down the umbrella shaft coupled for pivoting an array of stretcher struts, each pivotally fastened between a canopy rib at its distal end, and the strut sleeve at its proximal end, and an associated array of actuator struts each pivotally fastening between a stretcher strut and the runner sleeve for pivoting the stretcher struts between a vertical, closed, position substantially parallel to the umbrella shaft to a horizontal, open, position substantially perpendicular to the umbrella shaft, spreading and closing the canopy as the runner sleeve respectively slides up and down the umbrella shaft, a replaceable direct electrical power source incorporated into the handle connected for energizing an electrical circuit, a plurality of light sources received in sockets mounted proximate the distal ends of some of the stretcher struts energized by the electrical circuit; a manual on/off switch incorporated into the bottom handle electrically connected for energizing and de-energizing the electrical circuit, and further including a means for establishing an internal electrical circuit extending from the handle through the stretcher struts, light sources and canopy ribs, comprising in combination therewith, a) the strut sleeve the runner sleeve and the capping ferrule supporting the canopy ring each being composed of an electrically insulating material;

b) the umbrella shaft, the canopy ribs, the stretcher struts, the and supported canopy ring each being composed of an electrically conductive material, c) a wire port communicating through the central hollow umbrella shaft located above the strut sleeve at the open position;

d) an electrically conductive spring ferrule with an conductive annular shoulder secured around the umbrella shaft located slightly below the wire port;

e) an insulated wire lead electrically connected to the manual on/off switch internally threading from the handle, up the central hollow umbrella shaft out the wire port and electrically connecting to a canopy rib;

f) an electrically conductive, annular contact plate mounted around and carried by the strut sleeve;

g) an electrically conductive spring journaled around the umbrella shaft below the spring ferrule and above the strut sleeve sized to be compressed between the annular shoulder of the spring ferrule and the conductive, annular contact plate mounted around the strut sleeve;

h) an electrical contact mounted at the proximal end of each stretcher strut dimensioned and located to engage and establish an electrical connection with the annular contact plate when the stretcher struts are pivoted to the horizontal, open, position substantially perpendicular to the umbrella shaft and the electrically conductive spring is compressed between the annular contact plate of carried by the strut sleeve and the annular shoulder of the spring ferrule;

i) an insulated wire lead connecting between the electrical contact and a positive pin of each light source received in the socket mounted proximate the distal end of the stretcher strut; and j) a grounding electrical connection between a negative pin of each light source received in the mounted socket and the stretcher strut; and k) an electrical conduction path through the pivot couple between the distal end of each stretcher strut, and a canopy rib;

l) an electrical conduction path through couples between the canopy ribs and the canopy ring supported by the ferrule terminating the umbrella shaft; and m) an electrical conduction path from the umbrella shaft to the on/off switch connecting with the replaceable, direct current, electrical power source incorporated into the handle.

2. The illuminated umbrella of claim 1 wherein a plurality of light sources received in sockets mounted proximate the distal ends of some of the stretcher struts are a combination of colored LEDs.

* * * * *